US005400750A

United States Patent [19]

Jaeger et al.

[11] Patent Number: 5,400,750

[45] Date of Patent: Mar. 28, 1995

[54] MANIFOLD AND PLENUM CONSTRUCTION FOR AN ELECTRONIC FUEL INJECTED ENGINE

[75] Inventors: Matthew W. Jaeger, Fond du Lac, Wis.; John E. Lingenfeleter, Decatur, Ind.; Steven M. Lippincott, Stillwater, Okla.; Jerry M. Stoll, Jr., Stillwater, Okla.; Brian R. White, Stillwater, Okla.; Timothy M. Biggs, Stillwater, Okla.

[73] Assignee: Brunswick Corporation, Lake Forest, Ill.

[21] Appl. No.: 104,439

[22] Filed: Aug. 9, 1993

[51] Int. Cl.[6] ..... F02B 75/20

[52] U.S. Cl. ..... 123/184.47

[58] Field of Search ..... 123/52 MC, 52 M, 52 MV, 123/52 MB

[56] References Cited

U.S. PATENT DOCUMENTS

| | | | |
|---|---|---|---|
| 3,520,284 | 7/1970 | Ruoff et al. | 123/52 MV |
| 3,884,201 | 5/1975 | Cregan | 123/52 MV |
| 4,445,466 | 5/1984 | Zaita et al. | 123/52 MV |
| 4,649,871 | 3/1987 | Hatamura et al. | 123/52 MC |
| 4,817,566 | 4/1989 | Newman | 123/52 MV |
| 4,932,367 | 6/1990 | Newman et al. | 123/52 MV |
| 5,092,284 | 3/1992 | Yamada | 123/52 MB |

*Primary Examiner*—David A. Okonsky
*Assistant Examiner*—M. Macy
*Attorney, Agent, or Firm*—Andrus, Sceales, Starke & Sawall

[57] ABSTRACT

An improved intake manifold and plenum construction for an electronic fuel injected engine. The manifold includes a plurality of parallel runners, with each runner having a lower end communicating through a port in the cylinder head with a cylinder of the engine, and an open upper end. A fuel injector is mounted in each runner for injecting fuel into the runner. A plenum is mounted on the manifold and includes an upper wall and a lower wall which is spaced from the upper wall to define an air chamber, The upper ends of the runners communicate with the chamber, so that air is drawn from the chamber through the runners to the cylinders. A flange is spaced from the upper end of each runner, and the lower wall of the plenum is supported on the flanges so that the upper end of each runner projects into the plenum chamber, Hollow posts extend between the upper and lower walls of the plenum and bolts extend through the hollow posts and are threaded into the flanges on the runners to connect the plenum to the manifold.

11 Claims, 2 Drawing Sheets

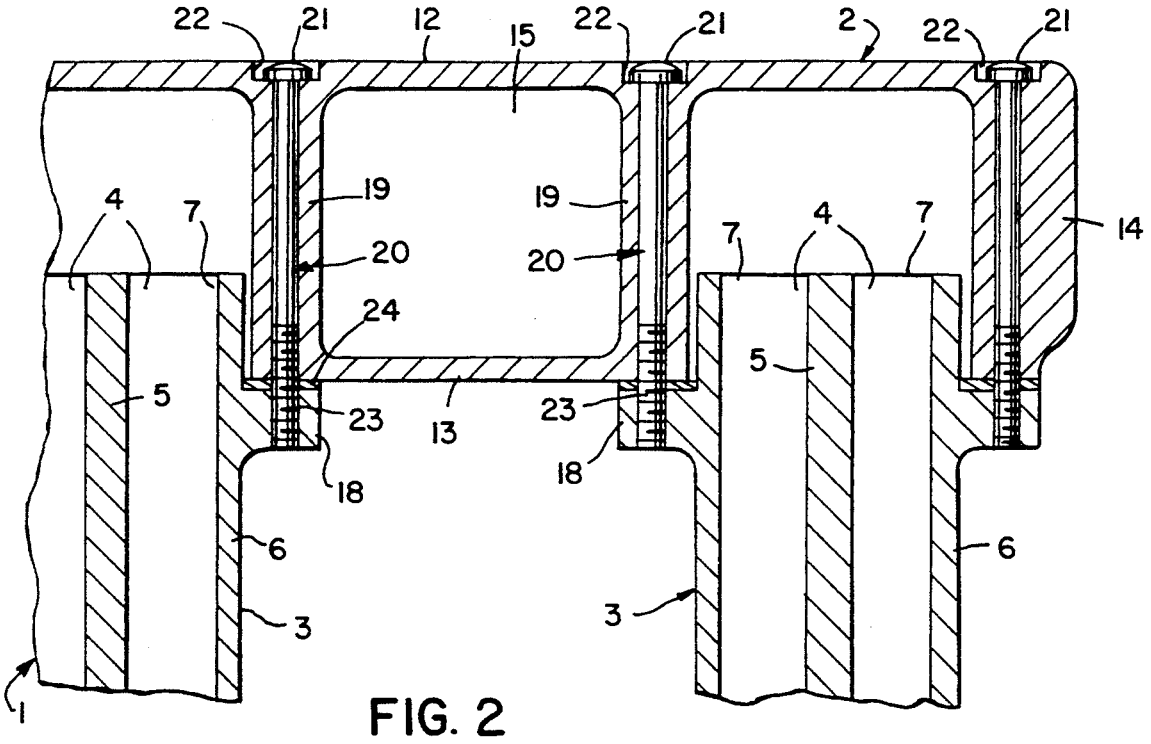
FIG. 2
FIG. 3
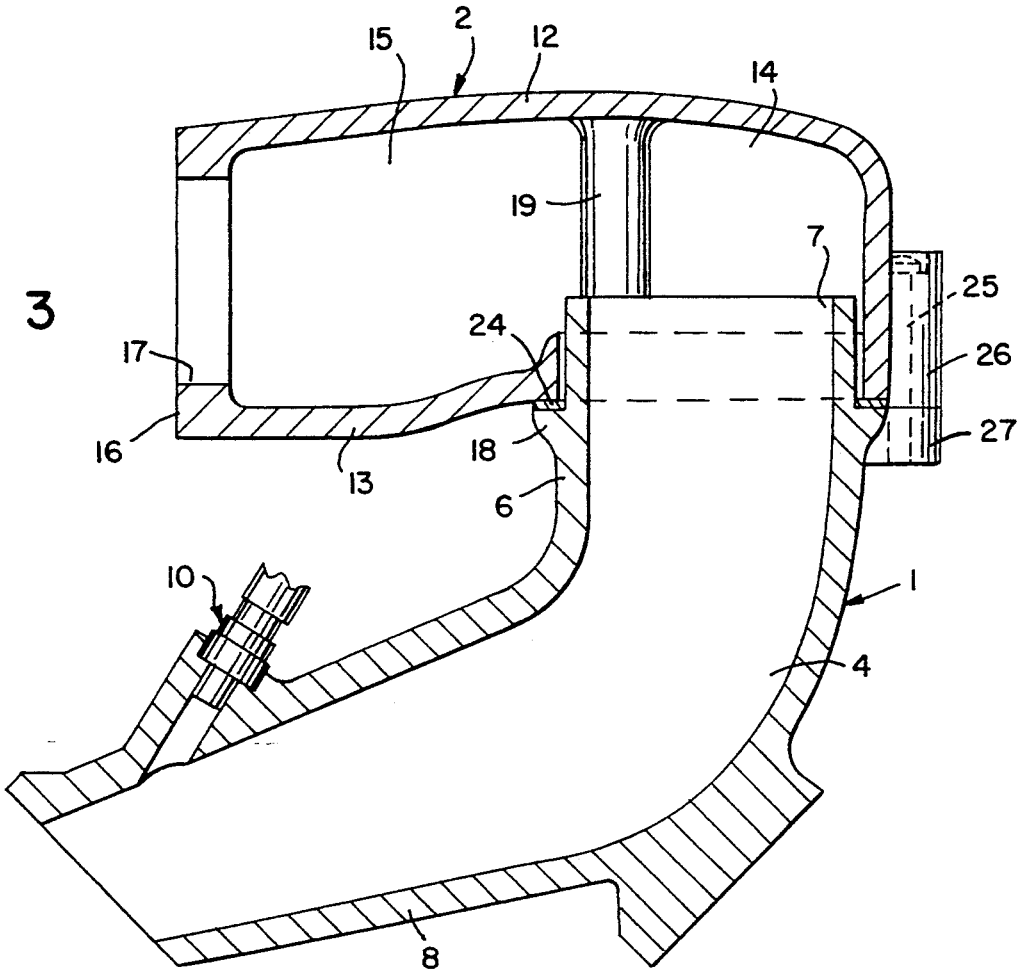

MANIFOLD AND PLENUM CONSTRUCTION FOR AN ELECTRONIC FUEL INJECTED ENGINE

BACKGROUND OF THE INVENTION

In a cross ram intake manifold, as commonly used in electronic fuel injected engines, the manifold runners extend transversely of the longitudinal dimension of the manifold. As used with an eight cylinder engine, a first group of four runners extend diagonally down from one side of the manifold toward the opposite side, while a second group of four runners extend diagonally down from the opposite side of the manifold. Thus, both groups of runners extend transversely of the engine in a crossing pattern.

The lower end of each runner communicates with a cylinder of the engine, while the upper end of each runner communicates with the interior of an air plenum. Fuel is fed into each runner through a fuel injector which is mounted within an opening in the runner intermediate the ends thereof. Air is introduced into the plenum through a throttle body and is then drawn into the open upper ends of the runners.

It is known that varying the runner length and cross section will effect the tuning of the runner. If the length of the runner is increased, a lower RPM peak will be obtained. However, by increasing the runner length, the overall size of the manifold will normally also be increased. Theoretically, as the RPM peak is increased, the cross-sectional area of the runner should increase and the runner length should decrease. However, in practice, the configuration of the runners is determined primarily by packaging or size constraints.

With a marine engine, it is desirable to tune the engine to obtain high torque at low RPM for the high torque is desirable for pulling water skiers and for getting the boat on a plane.

The typical plenum, as used in a marine engine, is an aluminum casting and is bolted from the bottom to the manifold. The typical plenum includes an upper wall and a lower wall, which is spaced from the upper wall to provide an air chamber therebetween. If top bolting is employed, in which the heads of the bolts are located on the upper surface of the plenum, torquing down of the bolts can cause deformation of the upper wall of the plenum. As a consequence, it has been customary to use bottom bolting for connecting the plenum to the manifold, in which the heads of the bolts bear against the manifold and the bolts extend upwardly and are threaded into the plenum. However, With bottom bolting the bolt heads are located in relatively inaccessible locations which makes servicing difficult.

SUMMARY OF THE INVENTION

The invention is directed to an improved intake manifold and plenum construction for an internal combustion engine, and in particular to an intake manifold and plenum construction for a high performance electronic fuel injected marine engine.

The manifold includes a plurality of parallel runners that extend transversely of the longitudinal dimension of the engine, and each runner includes a lower end that mates with a port in the cylinder head that leads to a cylinder, and an open upper end. A fuel injector is mounted in an opening in each runner between the ends thereof and serves to inject fuel into the runners.

A plenum is mounted on the upper end of the manifold and includes an upper wall and a lower wall which is spaced from the upper wall to define a chamber therebetween. Air is introduced into the plenum chamber through a throttle body assembly, which is mounted within an inlet opening in the plenum. The open upper ends of the runners communicate with the plenum chamber.

As a feature of the invention, each runner is provided with an outwardly extending flange or shoulder which is spaced downwardly from the open upper end of the runner and the lower wall of the plenum is supported on the flanges. With this arrangement, the open upper end of each runner projects into the chamber, thereby providing an increased length for the runner without increasing the overall height or dimension of the engine. By increasing the length of the runners a lower RPM peak is achieved. Further, the runners are cast as a one-piece construction, so that there are no joints in the runners which could impede the air flow.

To mount the plenum on the manifold, a series of hollow posts or columns interconnect the upper and lower walls of the plenum, and bolts extend through the hollow posts and are threaded in openings formed in the flanges that border the runners. With this construction, bolting is done from the top with the heads of the bolts being fully exposed, thus increasing serviceability over prior constructions in which bottom bolting was used.

In addition, the hollow posts increase the strength and rigidity of the plenum and also serve to reduce vibrations.

Other objects and advantages will appear in the course of the following description.

DESCRIPTION OF THE DRAWINGS

The drawings illustrate the best mode presently contemplated of carrying out the invention.

In the drawings:

FIG. 2 is a section taken along line 2—2 of FIG. 1; and

FIG. 3 is a section taken along line 3—3 of FIG. 1.

DESCRIPTION OF THE ILLUSTRATED EMBODIMENT

Figure 1:
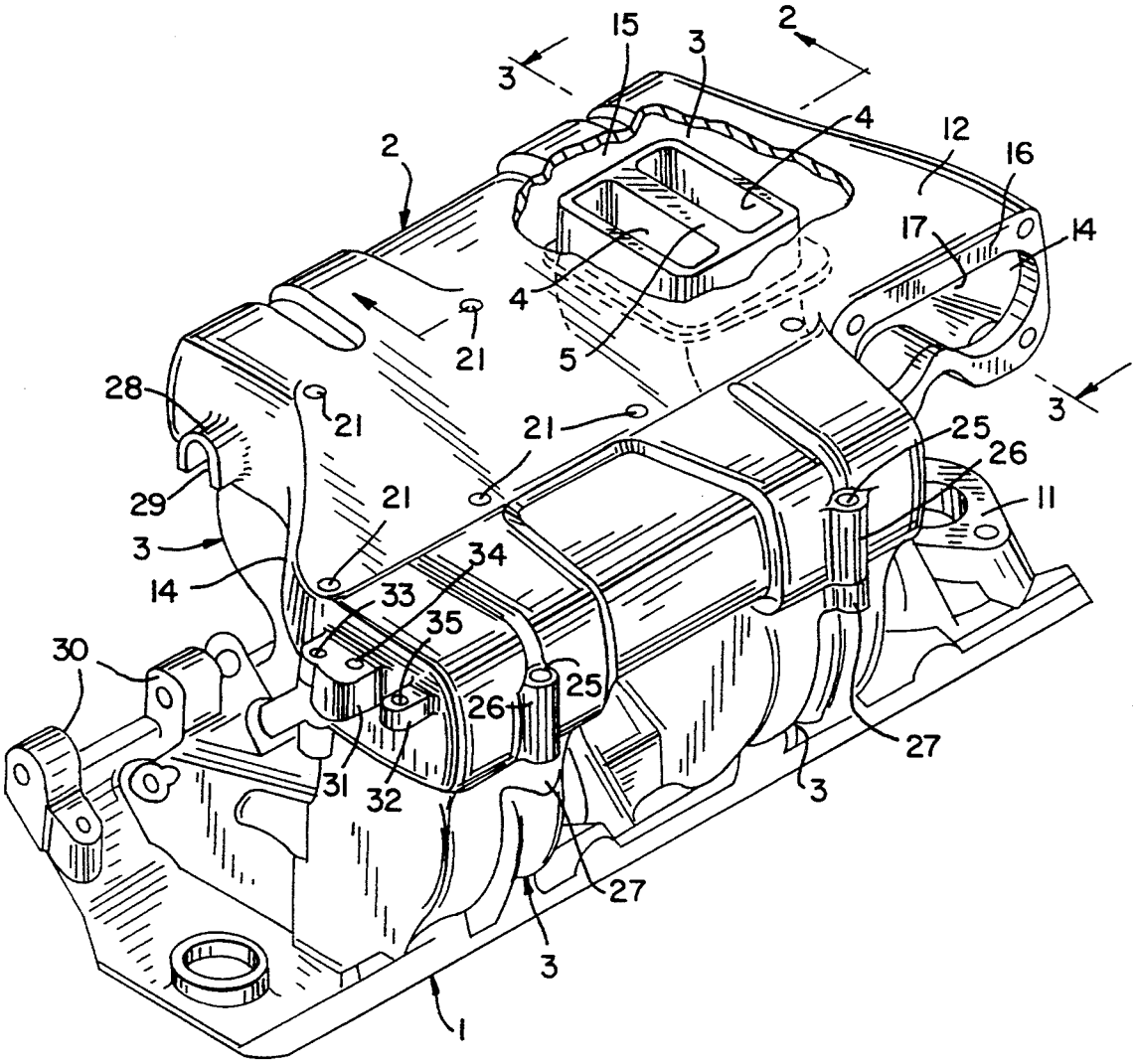
FIG. 1 is a perspective view of the manifold and plenum construction of the invention with parts broken away in section.

FIG. 1 illustrates an intake manifold and plenum construction having particular use with an electronic fuel injected marine engine. As illustrated, the manifold and plenum construction is incorporated with an eight cylinder engine, although it is contemplated that the construction can be used with other engines.

The construction of the invention includes an intake manifold 1, which is supported on the engine block, not shown, and a plenum 2 is mounted on manifold 1.

Manifold 1 includes a plurality of runner sets or units 3 with each runner unit including a pair of side-by-side runners or passages 4 which are separated by a central wall 5. With an eight cylinder engine, as illustrated in FIG. 1, there are four runner units 3, with each runner unit including a pair of runners 4.

As best shown in FIG. 3, each runner 4 includes an upper vertical section 6 which terminates in an open end 7. A diagonal section 8 extends diagonally from the lower end of the vertical section 6 and communicates with a cylinder of the engine block. As best shown in FIG. 1, the runners 4 have a generally rectangular cross section, and the cross section varies throughout the length of the runner. In this regard, the upper end 7 of each runner is more elongated than the lower end.

Runners 4 all have the same length and cross section configuration, and extend transversely of the longitudinal dimension of the manifold. A pair of runner units 3 extend diagonally downward from the upper left hand side of the manifold, as viewed in FIG. 1, toward the lower right hand side, while a second pair of runner units 3 extend from the upper right hand side, diagonally downward toward the lower left hand side. Thus, one pair of runner units 3 is in a crossing pattern with the other pair of runner units.

Fuel is injected into each runner 4 through a conventional fuel injector 10, which is mounted within an opening in the diagonal section 8 of each runner.

As shown in FIG. 1, one end of the manifold is formed with a flat surface 11 which border an opening that connects with a water outlet port on each cylinder head, and in the assembled engine a thermostat housing is mounted on the surface 11. The thermostat housing can be constructed as described in U.S. patent application Ser. No. 08/104,379, filed Aug. 8, 1993 and assigned to a common assignee with the present invention.

Plenum 2 includes an upper wall 12 and a parallel lower wall 13 which are connected by a side wall 14. Plenum 2 defines an internal plenum chamber 15, which communicates with the open upper ends 7 of runners 4 so that air from chamber 15 will be drawn into the runners through the upper ends 7.

Air is introduced into the chamber 15 through a throttle body assembly, not shown, which is mounted to surface 16 that borders an air inlet opening 17. The throttle body assembly can be constructed as described in U.S. patent application Ser. No. 08/104,380, filed Aug. 8, 1993 and assigned to a common assignee with the present invention.

To mount the plenum 2 to manifold 1, each runner unit 3 is formed with an outwardly extending flange or shoulder 18, which extend around the periphery of the runner unit and is spaced beneath the open upper end 7 of the runners 4, as best illustrated in FIG. 2. The lower wall 13 of plenum 2 rests on the flange 18. Flange 18 is located below the upper ends of runners 4 to allow lower packing height without decreasing plenum air volume.

Connecting the upper and lower walls 12 and 13 are hollow posts or columns 19, and bolts 20 extend through the posts and serve to connect the plenum 2 to the manifold 1. As illustrated in FIG. 2, the heads 21 of bolts 20 are located in recesses 22 in upper wall 12, and the lower threaded ends 23 of the bolts are threaded within openings in flanges 18. A gasket 24 is located between the lower wall 13 of the plenum and the upper surfaces of flanges 18.

Posts 19 provide increased strength and rigidity for plenum 2 and enable the bolt heads 21 to be located at the upper wall 12 of the plenum. Because of the reinforcing posts 19, any excessive torque applied to the bolts 20 will not deform upper wall 12. As the bolt heads 21 are located in an accessible location, servicing of the plenum and manifold is greatly improved over a construction utilizing bottom bolting. This construction avoids openings in the chamber 15 that could cause air leaks around fasteners.

In addition to the bolts 20 which extend through posts 19, a group of bolts 25 extend through sleeves 26 attached to side wall 14 of plenum 2 and are threaded in bosses 27 on the manifold.

As shown in FIG. 1, a projection 28 extends outwardly from side wall 14 of plenum 2 and defines an inverted U-shaped recess 29. The recess is adapted to receive a projection on a vapor separating tank, not shown, which is mounted to the plenum and manifold. In the assembled engine, legs on the vapor separating tank are connected to lugs 30 on manifold 1. The separating tank can be constructed as shown in U.S. patent application Ser. No. 08/104,772, filed Aug. 10, 1993 and assigned to a common assignee with the present invention.

A provision is also included for mounting a manifold absolute pressure sensor to plenum 2. In this regard, one end of the plenum is formed with a pair of spaced projections 31 and 32. Holes 33 and 34 are machined in projection 31, while a single hole 35 is machined in projection 32. Holes 33 and 35 serve as mounting holes for the sensor, while hole 34 communicates with a horizontal hole that is cast in the plenum and provides a connection to the plenum chamber 15. The sensor, not shown, is a conventional type which serves to sense the pressure in the plenum and manifold.

As the upper ends of the runners 4 project a substantial distance into the chamber 15 of plenum 2, the overall length of the runners is increased without an increase in the height or overall size of the engine. The increased runner length, along with the cross sectional configuration of the runners, provides a lower RPM peak which is desired in a high performance marine engine.

The runner units 3 are a one-piece structure, so that there are no joints in the runners which could impede air flow.

The use of the columns or posts 19 not only increases the strength and rigidity of the plenum, enabling the plenum to be attached to the manifold by top bolting, but also minimizes vibrations, and avoids possible air leak passages around fasteners.

Various modes of carrying out the invention are contemplated as being within the scope of the following claims particularly pointing out and distinctly claiming the subject matter which is regarded as the invention.

We claim:

1. An intake manifold and plenum construction for a marine engine, comprising a manifold including a runner having a first open end and a second end communicating with a cylinder of the engine, fuel injection means connected to the runner for injecting fuel into the runner, a plenum mounted on the manifold and including an upper wall and a lower wall spaced from the upper wall to define a chamber therebetween, inlet means for introducing air into the chamber, said lower wall having an opening, said runner disposed in said opening and the first open end of the runner communicating with the chamber, and rigid abutment means on said runner and being spaced from said first open end, said abutment means having an upwardly facing surface, said lower wall being supported on said upwardly facing surface and said first open end projecting a substantial distance into said chamber.

2. The construction of claim 1, wherein said manifold is elongated and said runner extends transversely of the longitudinal dimension of said manifold.

3. The construction of claim 1, and including removable connecting means for connecting said plenum to said manifold.

4. The construction of claim 3, wherein said connecting means comprises a plurality of bolts, each bolt having a head disposed in bearing engagement with the upper wall of the plenum and having a lower end threadedly engaged with an opening in said abutment means.

5. The construction of claim 4, and including a plurality of hollow columns interconnecting said upper and lower walls, each bolt extending through a column.

6. An intake manifold and plenum construction for a high performance electronic fuel injected engine, comprising a manifold including a plurality of parallel spaced runners, each runner having an open upper end and having a lower end communicating with a cylinder of the engine, fuel injecting means for injecting fuel into each runner, a plenum mounted on the manifold and including an upper wall and a lower wall spaced from the upper wall to define a chamber therebetween, inlet means for introducing air into said chamber, the upper end of each runner communicating with said chamber, an abutment on each runner adjacent the upper end of the runner, said lower wall resting on said abutments, a plurality of hollow columns extending through the chamber and interconnecting said upper and lower walls, and connecting means extending through each hollow column for connecting said plenum to the manifold.

7. The construction of claim 6, wherein said abutment comprises a flange extending outwardly from each runner and spaced from the upper end of the runner whereby the upper end portion of each runner projects into said chamber.

8. The construction of claim 6, wherein said connecting means comprises a plurality of bolts, each bolt having a head disposed in bearing engagement with said upper wall and a lower end threadedly engaged with said flange.

9. The construction of claim 7, wherein said flange extends completely around the periphery of each runner.

10. The construction of claim 6, wherein a first group of said runners extends diagonally downward from an upper portion of a first side of said manifold to a lower portion of a second side of said manifold and a second group of said runners extends diagonally downward from an upper portion of said second side to a lower portion of said first side.

11. The construction of claim 6, wherein a first pair of said runners are disposed in side-by-side relation and are separated by a first internal wall, and a second pair of said runners are in side-by-said relation and are separated by a second internal wall.

* * * * *